United States Patent [19]

Kalenian

[11] 4,228,783

[45] Oct. 21, 1980

[54] COMBUSTION HEATER

[76] Inventor: Paul A. Kalenian, 73 Otis St., Northboro, Mass. 01532

[21] Appl. No.: 844,272

[22] Filed: Oct. 21, 1977

[51] Int. Cl.[2] ..... F24H 3/06

[52] U.S. Cl. ..... 126/112; 126/77

[58] Field of Search ..... 126/15, 77, 78, 110, 126/112, 146, 193, 109, 117; 110/302, 308

[56] References Cited

U.S. PATENT DOCUMENTS

| | | | |
|---|---|---|---|
| 381,750 | 4/1888 | Bacon | 126/112 |
| 455,542 | 7/1891 | Emerson | 126/112 |
| 561,817 | 6/1896 | Ross | 126/112 |
| 4,078,541 | 3/1978 | Roycraft | 126/112 X |

*Primary Examiner*—David H. Corbin

*Attorney, Agent, or Firm*—Jerry Cohen

[57] ABSTRACT

A wood burning combustion heater comprises a combustion chamber for long logs arranged to burn down from one end to the other in cigar-like fashion, an after-burner tube arrayed above and essentially parallel to the elongated logs with the air and burned gasses following an S-shaped path through the combustion chamber and out through the exhaust tube, an after-burner within said tube and a heat exchanger fed by the exhaust from said tube for heating air in indirect heat exchange and characterized further by an incoming air passage annulus surrounding the combustion chamber for pre-heating thereby; multiple levels of air admission for controlling combustion; electric ignition at the after-burner; bathing the exhaust tube, containing the after-burner, in flame through admission of secondary air to the region outside such tube; and high mass for even dissipation of heat.

4 Claims, 2 Drawing Figures

COMBUSTION HEATER

BACKGROUND OF THE INVENTION

The present invention relates to wood fired combustion heaters.

It is an important object of the invention to effectively utilize wood as a fuel for heating residences, factories, greenhouses, warehouses, and other buildings or spaces.

It is a further object of the invention to substantially completely consume all combustibles of a wood fuel charge consistent with the preceding object.

It is a further object of the invention to provide economy of operation consistent with one or more of the preceding objects.

It is a further object of the invention to provide effective burning rate and temperature controls consistent with one or more of the preceding objects.

It is a further object of the invention to separate heat production from heat removal and to have the hottest possible fire box environment for greater efficiency consistent with one or more of the preceding objects.

It is a further object of the invention to pre-heat all the intake combustion air utilizing the normal radiant energy available from the firebox walls consistent with one or more of the preceding objects.

It is a further object of the invention to electrically ignite any unburned smoke content in the exhaust and it is a still further object of the invention to provide for drainage of recondensed water from the burning of green wood.

It is a further object of the invention to minimize pollutant generation consistent with one or more of the preceding objects.

It is a further object of the invention to provide good usage of space in terms of effective heating obtained, consistent with one or more of the preceding objects of the invention.

It is a further object of the invention to provide a fail-safe and useful mode of operation in the event of electrical power failure consistent with one or more of the preceding objects.

It is a further object of the invention to adapt to conventional or existing hot air duct work systems for spreading heated air throughout an installation.

It is a further object of the invention to provide a long time, at least eight hours, between stokings of the burner, consistent with one or more of the preceding objects.

It is a further object of the invention to substantially reduce heat loss up the chimney to below 250° consistent with one or more of the preceding objects.

It is a further object of the invention to reclaim energy spent to vaporize water from green wood by recondensation consistent with one or more of the preceding objects.

It is a further object of the invention to dry out chimney gasses to avoid harming chimneys by freezing-out consistent with one or more of the preceding objects.

It is a further object of the invention to provide apparatus consistent with one or more of the preceding objects which is economical, transportable and easily installed and substantially maintainable by unskilled personnel and conveniently.

SUMMARY OF THE INVENTION

In accordance with the invention, a primary combustion chamber is provided for insertion of logs, preferably of standard four foot cordwood length (an economical way to buy or cut firewood). The elongated combustion chamber is preferably fed from the front. An exhaust tube is provided therein in a high portion thereof, above and generally parallel to the logs, and has an opening at the front of the combustion chamber. Air admission is limited so that the logs burn from front to back, rather than entirely along their lengths at once. The resultant air and combustion product moves along an S-shaped flow path (including transit of the exhaust gasses through the after-burner tube). Within the after-burner tube, additional air pre-heated is injected to create a new combustion therein. Pre-heated secondary air is injected into high regions of the combustion chamber parallel to the exhaust/after-burner tube so that there will be flames bathing the tube. In contrast, without such secondary air admission, there would be just smoke and hot air of considerably lower temperature around that tube.

Electric spark or glowplug ignition is provided within the exhaust/after-burner tube to maintain continuous afterburning whenever products of incomplete combustion are present.

The air for combustion is pre-heated and moved by passing around the combustion chamber itself (in heat exchange relation) before admission thereto, preferably through an annulus surrounding the combustion chamber with flow-directing ribs therein to assure a longitudinal component of flow and reduce hot spots in the firebox. The hot combustion creates suction draw of pre-heated combustion air and the forced drafting as a whole eliminates common chimney problems and allows for precise thermostatic control of temperature of the heated air. The pre-heating of air is used for all of the primary air, the secondary air and the after-burning air admission described above. Multiple fans are provided for force drafting, one running at all times to provide limited capacity air intake to barely sustain combustion ("idling" glow) and one or more other fans cut in to provide additional air to supplement the limited capacity first fan in response to a thermostat's signal call for higher room temperature thus more air. The fans are electrically operated, but in the event of a power failure, the furnace itself maintains sufficient heat from its high mass and natural suction draw to operate for as long a fuel wood is present.

The exhaust/after-burner tube exits immediately into an indirect heat exchanger comprising an inlet plenum, an outlet plenum and, therebetween, a multiplicity of tubes with a high surface area to a volume ratio of exhaust gas passage. Domestic air to be heated passes over such tubes and then into the regions of the room to be heated. In addition to ductwork conveying the heated air to various locations desired to be heated, the structure of the combustion chamber itself and of the heat exchanger comprise a source of significant heat for the surrounding room area. Such structures are made massive to constitute a built-in heat reservoir (or virtual flywheel effect) to evenly dissipate heat over a wide time span providing a more constant room temperature at any given control setting of air admissions. The primary control is through electrically varying one or more of the above described forced draft fans. This is adjusted by the remote control thermostat. Also, an automatic shut-down of combustion and circulator fan at the end of the fuel supply is provided through monitoring exhaust temperature through a thermostat on the wall of the final exhaust tube to shut off air supplies and to shut down electrical ignition upon consumption of fuel. An alarm or indicator to show that more stoking (wood reloading) is necessary can also be activated by the thermostat.

The primary chamber combustion produces a total combustion of solids and results in a light gray to white powder ash, indicative of an extremely lean and thorough burn. Minor unburned solids remain at times. Moisture and volatile gasses contained within the wood fuel are continuously driven off. Air admitted for the primary combustion and secondary combustion described above is pre-heated beyond the wood ignition temperature pre se and ignites many of the volatile gasses for more complete heat production and to avoid chimney and pollution problems. Hot oxygen-rich air is provided to lean flame tips to produce a blue lazy tipped flame resulting in measurable increase in heat output and observed improvement in color and reduction of exhaust emissions at the chimney. The exhaust is clear and cool.

Because of high combustion efficiency and heat transfer efficiency and large wood charge, typical models made in accordance with the invention can burn for 12–36 hours without stoking, variable by control of inlet air. Efficiency is further enhanced by extracting almost all the imparted heat from exhaust gas. It is chilled to well below 212° F. Moisture from the wood is converted to water vapor (steam) in the primary combustion chamber and after-burner and is recondensed in the heat exchanger and rapidly drained to avoid re-evaporation. The final exhaust is dry and doesn't condense out on the chimney to any substantial degree. The condensation represents a return of heat to the system to make up to the system, at least in part, the energy originally used to varporize the moisture content of wood.

The primary combustion chamber, including a preheating annulus therein for inlet air, and the heat exchanger constitute an easily transportable, pre-assembled, easily installed structure.

Other objects, features and advantages of the invention will be apparent from the following detailed description of preferred embodiments thereof, taken in connection with the accompanying drawing, in which,

DETAILED DESCRIPTION OF PREFERRED EMBODIMENTS

Figure 2:
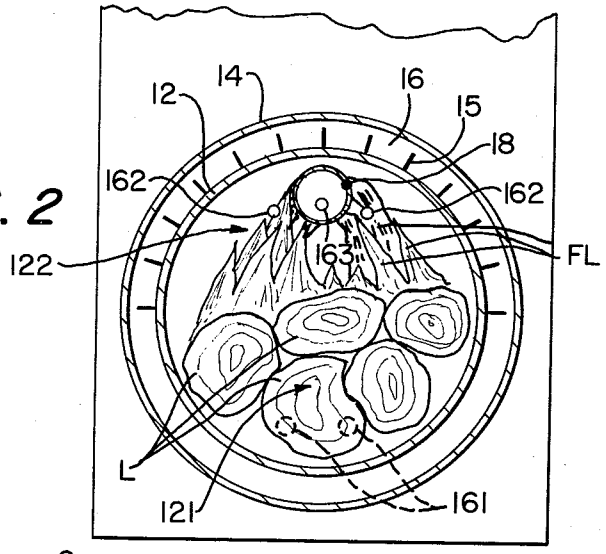
FIG. 1 is a longitudinal section of a preferred embodiment of the invention and FIG. 2 is a lateral cross section thereof, taken as indicated at 2—2 in FIG. 1.
Figure 1:
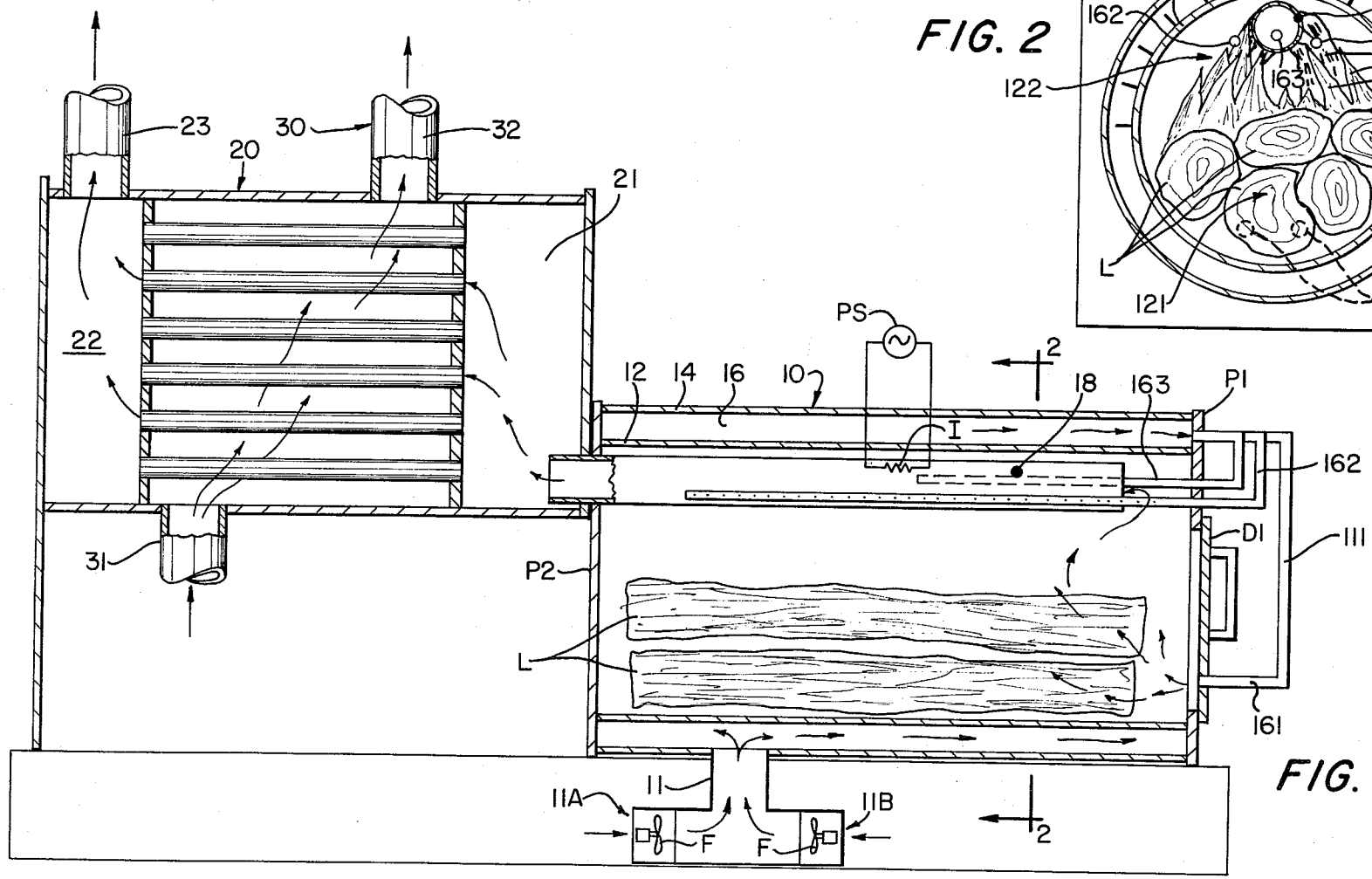

Referring now to FIGS. 1 and 2, there is shown the above described primary combustion chamber 10 and the above described heat exchanger 20 and air and exhaust gas ductwork 30,31,32 and 23.

The primary combustion chamber 10 comprises an inner chamber 12, an outer wall 14, with an annulus 16 therebetween containing longitudinally extending fins 15 for directing air (which enters at inlet 11) essentially longitudinally along the outer wall of inner chamber 12. Inner chamber 12 has a lower region 121 containing logs L and an upper region 122. Within the inner chamber upper portion 122, there is an after-burner/exhaust tube 18. Primary air for combustion comes to the primary combustion chamber via annulus 16 and two or more spaced pipes 161 (elbows). Secondary air for the upper portion 122, comes from annulus 16 via two or more spaced pipes 162 (elbows). Similarly, the elbow pipe 163 provides the after-burner air from space 16 to tube 18. The secondary air pipes 162 have holes along their lengths as they run parallel to the exhaust/after-burner tube. Air fed into these pipes induces the complete combustion which causes flames to reach out and touch the pipe 18 as indicated at FL in FIG. 2. In the absence of the secondary air, the flames would be lower and less consistent in reaching pipe 18 to maintain it very hot. Inlet air comes through pipes 11A and 11B, each of which have a fan F therein, one of which continually operates and the other which is selectively controlled. Both are electrically driven. The idle air provided by the continuous fan provides just enough combustion air to maintain a rekindleable fire (glow) and the second fan provides to the fire more than twice as much air as the idle situation to speed up combustion, producing greater flames and heat. A circulator fan (not shown) is provided in the heat exchanger system and can be set to run at one speed, at different selected c.f.m.

The heat exchanger 20 comprises an inlet plenum 21, an exhaust plenum 22 for waste gasses and an exit 23 to the smokestack and air inlet and outlet passages 31 and 32, respectively. An electric spark igniter for the after-burner is indicated at I and has an electrical power supply PS externally (which may be alternating or a connection to house power via a transformer). Preferably it operates continuously, but it may be provided with a switch for selective use of the exhaust after-burning.

Typical dimensions and construction parameters for a unit which has been operated effectively are—one-half inch thick steel, 100% welded primary chamber and a $\frac{3}{8}$ inch thick steel 100% welded heat exchanger. The primary and secondary chambers are about 4.5 ft. long each and each is less than 3 ft. in diameter. They have a total weight of the two of about one and one-half tons.

A front plate P1 of the primary chamber contains a loading door D1 of about 17×12 inches, within a clean-out door of circular form and about 23 inches diameter, both being hinged. Typically, the circulator/blower will handle 2,000 cu. ft. per minute up to 100 ft. of 12" ductwork or equivalent.

The furnace described above can be integrated with other heating systems or used for purposes other than domestic heating, and in turn, can borrow from existing components for implementation at any given installation.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Combustion heater comprising first means defining a combustion chamber with inner and outer walls and an annulus therebetween and with a lower space within the inner wall having a forward end and rear end for holding an elongated solid fuel charge and means for feeding primary air thereto and combustion gas products therefrom both at said forward end so that the charge burns from said forward towards said rear end of said chamber, second means defining an elongated combustion gas products conduit running above and substantially parallel to the fuel charge space and within the flame produced thereby and having an entrance for combustion gas products of said first means, said first and second means being arranged to define an S-draft gas flow path, means defining a principal heat exchanger for receiving the exhaust of said conduit and extracting heat therefrom, and means for injecting secondary air into the combustion chamber outside of and adjacent to the exhaust conduit at multiple points along the length thereof to enhance flame coverage thereof, means for producing after-burning in said conduit by injecting secondary air therein at a point downstream of the conduit entrance, and means for preheating the primary air and secondary air and after-burner air in counter-current heat exchange in said combustion chamber annulus by injection to said annulus at the combustion chamber rear end and movement to said forward end.

2. Combustion heater in accordance with claim 1 wherein said last mentioned means comprise means defining an annular space around said combustion chamber and means therein for creating a tortuous flow path for air therein.

3. Combustion heater in accordance with claim 1 comprising means for passing air to be burned first over the combustion chamber in heat exchange relation therewith and then into the chamber and then passing the combustion products through the said principal heat exchanger with surfaces and operating conditions adjusted so that all of the heat input into the air to be heated is obtained from the said principal heat exchanger.

4. Combustion heater in accordance with claim 1 wherein an air jacket is provided to hold the walls of the combustion chamber above ambient temperature.

* * * * *